US011428447B2

(12) United States Patent
Renesto et al.

(10) Patent No.: US 11,428,447 B2
(45) Date of Patent: Aug. 30, 2022

(54) SINGLE-VALVE CO2 REFRIGERATING APPARATUS AND METHOD FOR REGULATION THEREOF

(71) Applicant: CAREL INDUSTRIES S.p.A., Brugine (IT)

(72) Inventors: Dimitry Renesto, Brugine (IT); Diego Malimpensa, Brugine (IT)

(73) Assignee: CAREL INDUSTRIES S.P.A., Brugine (IT)

( * ) Notice: Subject to any disclaimer, the term of this patent is extended or adjusted under 35 U.S.C. 154(b) by 99 days.

(21) Appl. No.: 16/951,210

(22) Filed: Nov. 18, 2020

(65) Prior Publication Data

US 2021/0148618 A1 May 20, 2021

(30) Foreign Application Priority Data

Nov. 19, 2019 (IT) ..... 102019000021534

(51) Int. Cl.
*F25B 41/20* (2021.01)
*F25B 13/00* (2006.01)

(52) U.S. Cl.
CPC ..... *F25B 41/20* (2021.01); *F25B 13/00* (2013.01)

(58) Field of Classification Search
CPC .... F25B 13/00; F25B 41/20–28; F25B 40/00; F25B 40/06; F25B 2400/0419
See application file for complete search history.

(56) References Cited

U.S. PATENT DOCUMENTS 7,000,413 B2 * 2/2006 Chen ..... F25B 9/008 62/190
8,745,996 B2 * 6/2014 Qiao ..... F25B 9/008 62/115

(Continued)

FOREIGN PATENT DOCUMENTS

CN 113227678 A * 8/2021 ..... F25B 41/00
DE 112008002404 T5 * 7/2010 ..... F04B 27/1804

(Continued)

OTHER PUBLICATIONS

Search Report dated Apr. 28, 2020 from Italian Application No. IT 201900021534.

*Primary Examiner* — Miguel A Diaz
(74) *Attorney, Agent, or Firm* — Innovation Capital Law Group, LLP; Vic Lin

(57) ABSTRACT

Method for regulation of a single-valve $CO_2$ refrigerating apparatus including:

an operation A of detecting, over time, the value of a primary parameter and the value of a secondary parameter, wherein said primary parameter is chosen from said high pressure HP and said superheat temperature Tsh, wherein said secondary parameter is said superheat temperature Tsh if said primary parameter is said high pressure HP or is said high pressure HP if said primary parameter is said superheat temperature Tsh;

a primary regulation operation B, which involves regulation of said expansion valve (13) so that the value of said primary parameter tends towards a set-point value;

an operation C of estimating an optimal value Vo for said secondary parameter; and a secondary regulation operation D which involves varying said set-point value from an optimal set-point value (Continued)

or from a current value if the value of said secondary parameter does not fall within a predefined tolerance range.

20 Claims, 1 Drawing Sheet

(56) References Cited

U.S. PATENT DOCUMENTS

| | | | | |
|---|---|---|---|---|
| 9,958,190 | B2 * | 5/2018 | West | F25B 49/02 |
| 10,451,325 | B2 * | 10/2019 | Sun | F25B 49/02 |
| 2013/0180272 | A1 * | 7/2013 | Ono | F25B 49/02<br>62/115 |
| 2014/0151015 | A1 * | 6/2014 | Sun | F25B 41/00<br>62/190 |
| 2021/0180835 | A1 * | 6/2021 | Barta | F25B 11/02 |

FOREIGN PATENT DOCUMENTS

| | | | | |
|---|---|---|---|---|
| DE | 102019001638 | A1 * | 9/2020 | F25B 40/00 |
| EP | 3130870 | A1 | 2/2017 | |
| EP | 3961129 | A1 * | 3/2022 | |
| KR | 102372489 | B1 * | 3/2022 | |
| WO | 2013016403 | A1 | 1/2013 | |
| WO | WO-2020083823 | A1 * | 4/2020 | F25B 41/00 |

* cited by examiner

SINGLE-VALVE CO2 REFRIGERATING APPARATUS AND METHOD FOR REGULATION THEREOF

The present invention concerns a single-valve CO2 refrigerating valve and a method for regulation thereof.

In general, the present invention relates to a refrigerating apparatus which uses carbon dioxide as a refrigerant fluid and which may operate according to a transcritical thermodynamic cycle, namely a cycle wherein the dissipation of the operative heat is performed at a temperature higher than the critical temperature, which is 31° C.

Specifically, the present invention relates to a refrigerating apparatus intended for small-scale applications, as in the refrigeration of refrigerated cabinets, for example of supermarket refrigeration systems, and in particular for so-called plug-in or semi plug-in applications wherein there is a refrigeration unit equipped with an exchanger for dissipation of the operative heat which can be connected to a water loop circuit used for refrigeration.

The present invention may also be implemented in connection with single-valve refrigerating apparatus of other types, such as heat pumps for example.

BACKGROUND OF THE INVENTION

An apparatus according to an application of this type conventionally comprises a compressor assembly, a gas cooler, a single, electronic, expansion valve, an evaporator and a control device which is connected to the expansion valve so as to adjust the opening thereof according to a feedback algorithm designed to follow a predefined superheat value, called set-point value, of the gas at the evaporator outlet.

The expression "gas cooler" is understood as meaning a member which is designed to cool the gaseous carbon dioxide, also in supercritical conditions, i.e. at a pressure greater than 7.377 Mpa and temperature higher than 31° C., wherein there is no condensation of the fluid, or in conditions wherein there is a transition between subcritical conditions and supercritical conditions, differently from several conventional refrigerating apparatus wherein the dissipation of the operative heat involves condensation of the refrigerant fluid.

As already mentioned, the gas cooler may be connected to a exchanger of a water circuit for dissipation of the heat.

This conventional apparatus which below will be identified as a single-valve refrigerating apparatus, while being able to achieve high energy performance values, has a number of limitations in terms of efficiency compared to the larger-size apparatus.

The latter are also equipped with a gas-liquid receiver, upstream of the evaporator, with a high-pressure valve, connected downstream of the gas cooler so as to regulate the pressure thereof, and with a valve, called flash gas valve, connected downstream of the receiver, for regulating the internal pressure thereof, both these valves also being connected to the control device which operates them in a manner coordinated with the electronic expansion valve.

In particular, the control algorithm for a conventional apparatus of this type, in addition to the regulation of the expansion valve in relation to the superheat set point, described above, performs regulation of the high-pressure valve so as to optimize the COP (coefficient of performance) of the compressor assembly depending on the outlet temperature of the gas cooler and regulation of the flash gas valve so as to keep the pressure inside the receiver at a predefined value.

A conventional apparatus of this type therefore has a greater structural complexity, greater dimensions and greater costs which nowadays do not allow competitive use thereof in the aforementioned small-scale applications.

SUMMARY OF THE INVENTION

The problem underlying the present invention is to increase the energy efficiency of the single-valve CO2 refrigerating apparatus without increasing substantially the structural complexity or the overall dimensions thereof.

The main task of the present invention consists in providing a single-valve CO2 refrigerating apparatus and a method for regulation thereof, which are able to provide a solution to said problem, while overcoming the drawbacks associated with the conventional apparatus described above.

In connection with this task it is an object of the present invention to propose a single-valve CO2 refrigerating apparatus and a method for regulation thereof which are able to optimize operation with respect to a combination of functional thermodynamic parameters and specifically according to the superheat temperature at the evaporator outlet and according to the maximum cycle pressure.

Another object of the present invention consists in providing a single-valve CO2 refrigerating apparatus which does not have substantially larger dimensions compared to the conventional single-valve apparatus described above.

This task as well as these and other objects which will appear more clearly below are achieved by a single-valve CO2 refrigerating apparatus and a method for regulation thereof according to the attached independent claims.

Detailed characteristic features of a single-valve CO2 refrigerating apparatus and a method for regulation thereof according to the invention are described in the dependent claims which are incorporated here by reference.

BRIEF DESCRIPTION OF THE DRAWINGS

Further characteristic features and advantages will emerge more clearly form the description of a preferred, but non-exclusive embodiment of a single-valve CO2 refrigerating apparatus and a method for regulation thereof, according to the invention, shown by way of a non-limiting example in the attached sets of drawings in which.

DETAILED DESCRIPTION OF THE PREFERRED EMBODIMENTS

Figure 1:
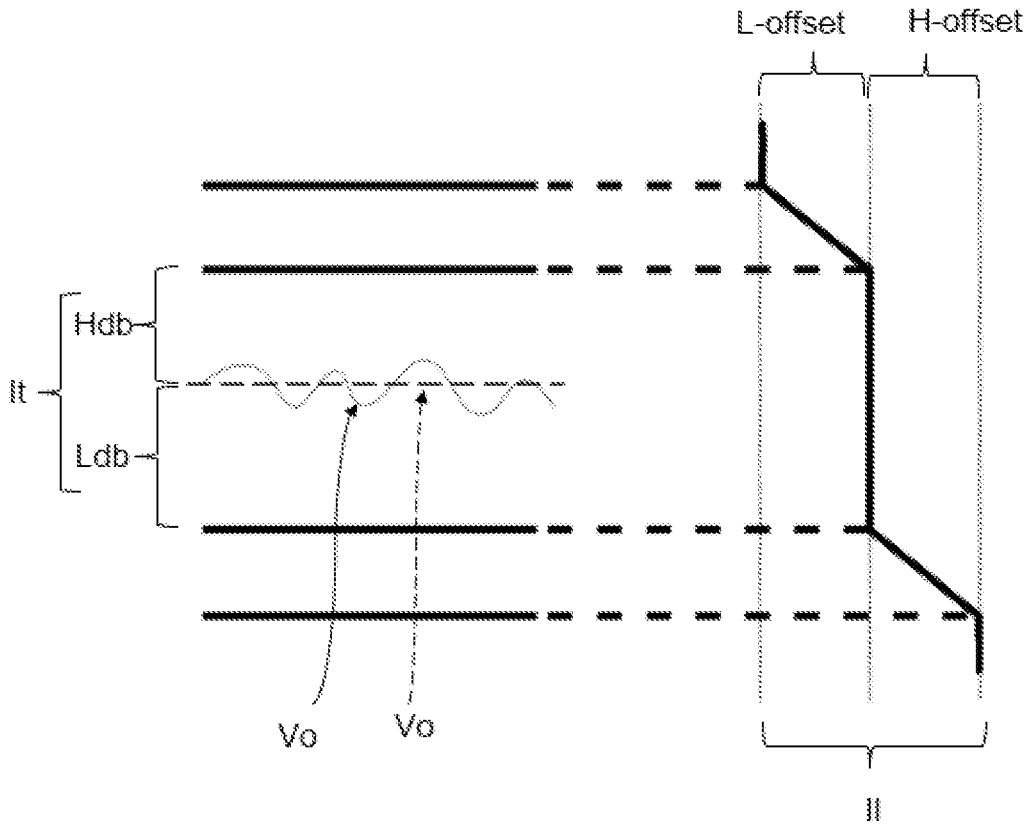
FIG. 1 shows an exemplary diagram of a control logic of a single-valve CO2 refrigerating apparatus in accordance with a method for regulation thereof, according to the present invention.
Figure 2:
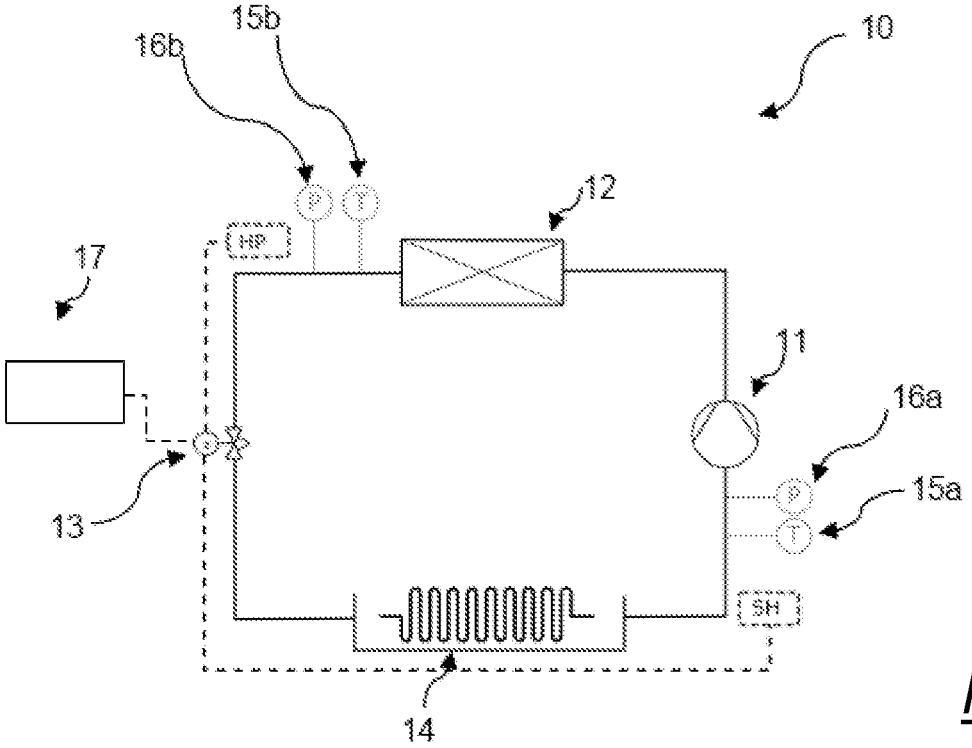
FIG. 2 shows a simplified diagram of a single-valve CO2 refrigerating apparatus, according to the present invention.

With particular reference to the said figures, 10 denotes overall a single-valve CO2 refrigerating apparatus, namely an apparatus which operates with a refrigerant fluid comprising carbon dioxide.

The apparatus 10 comprises, in sequence:

- a compressor assembly 11;
- a gas cooler 12 connected to the compressor assembly 11 so as to receive gas under pressure from it;

an expansion valve 13, with adjustable opening, located downstream of the gas cooler 12, for expanding refrigerant fluid supplied from the latter;

an evaporator 14, located downstream of the expansion valve 13 and upstream of the compressor assembly 11.

Furthermore the apparatus 10 comprises:

temperature detection means 15*a*, 15*b* configured to detect a superheat temperature value Tsh of the refrigerant fluid, preferably by means of temperature detection downstream of the evaporator 14 or upstream of the compressor 11 and to detect a temperature value of the refrigerant fluid, preferably downstream of the gas cooler 12.

pressure detection means 16*a*, 16*b*, for detecting a high-pressure value HP of the pressure of the refrigerant fluid downstream of the compressor assembly 11 and upstream of the expansion valve 13;

a controller 17 connected to the temperature detection means 15*a*, 15*b* and to the pressure detection means 16*a*, 16*b*, so as to receive data from them, and to the expansion valve 13 so as to adjust the opening thereof according to the following method.

In accordance with the present invention, a method for regulation of the single-valve CO2 refrigerating apparatus 10 comprises:

a continuous or discontinuous operation A of detecting, over time, the value of a primary parameter and the value of a secondary parameter;

a primary regulation operation B, which involves regulation of the expansion valve 13 so that the value of said primary parameter, detected in the operation A, tends towards a set-point value;

an operation C of estimating an optimal value Vo for said secondary parameter;

a secondary regulation operation D which involves varying said set-point value from an optimal set-point value, or from a current value, if the value of said secondary parameter, detected in the operation A, does not fall within a predefined tolerance range It of values comprising said optimal value Vo.

In connection with the operation A, said primary parameter is chosen from the high pressure HP and the superheat temperature Tsh, wherein the secondary parameter is the superheat temperature Tsh if the primary parameter is the high pressure HP or is the high pressure HP if the primary parameter is the superheat temperature Tsh.

In connection with the operation C, said optimal value Vo may be estimated according to an algorithm for energy optimization of the apparatus 10, as for example described more fully below.

In connection with the operation D, said variation is performed so as to tend to bring the value of the secondary parameter back within the tolerance range It.

If said primary parameter is said high pressure HP, the optimal set-point value may be calculated, in a manner conventional per se, for example as taught in the article "A correlation of optimal heat rejection pressures in transcritical carbon dioxide cycles" by S. M. Liao, T. S. Zhao, A. Jakobsen, published in "Applied Thermal Engineering" Applied Thermal Engineering 20 (2000) 831-841. In accordance with the teaching of said article, the optimal set-point value may be defined by means of the following formula:

$$Stp=(2.778-0.0157*te)*tc+(0.381*te-9.34)$$

wherein:

tc is the gas cooler outlet temperature 12 te is the saturated evaporation temperature, for example which can be obtained from the evaporation pressure pe converted into saturation temperature of the CO2.

The evaporation pressure pe may be the pressure of the refrigerant fluid detected at the outlet of the evaporator 14 or at the intake of the compressor 11, or at a section between them, as described more fully here below.

For example, a saturated evaporation temperature of −10° C. corresponds to an absolute evaporation pressure pe of 2.648 Mpa.

As can be understood, therefore, the optimal set-point value, when the primary parameter is said high pressure, may be variable and updated continuously or at discrete time intervals according to the formula shown above, or according to other correlations conventional per se and not further described here, depending on the aforementioned values of tc and te measured and/or depending on other parameters useful of the purposes of the calculation of an optimal pressure such as to the maximize the efficiency of the cycle.

If the primary parameter is the superheat temperature Tsh, the optimal set-point value may be set and fixed.

The value of said superheat temperature may be calculated as the difference between the temperature measured ts, detected at the intake of the compressor assembly 11 or at the outlet of the evaporator 14 and the saturated evaporation temperature te, obtained as mentioned further above, namely in the formula Tsh=ts−te.

For example, where an absolute evaporation pressure pe=2.648 Mpa is detected, a saturated temperature te=−10° C. and, if a measured temperature ts=0° C. is detected, there will be an superheat SH=ts−te=10 K.

The operation D may envisage that said variation is limited to values of said set-point value which are comprised within a predefined limit range II which comprises an optimal set-point value.

In connection with the operation B the regulation of the expansion valve 13 may involve a feedback check, preferably of the proportional-integrative-derivative (PID) type, between the value of the primary parameter detected and the set-point value Stp.

In particular, if the primary parameter is the superheat temperature Tsh, if the value of the superheat temperature Tsh is greater than the set-point value Stp, the expansion value 13 may be operated so as to increase the opening thereof in order to reduce the superheat temperature Tsh or, vice versa, if the value of the superheat temperature Tsh is less than the set-point value Stp, the expansion valve 13 may be operated so as to reduce the opening thereof in order to increase the superheat temperature value Tsh.

Similarly, if the primary parameter is the high pressure HP, if the value of the high pressure HP is greater than the set-point value Stp, the expansion valve 13 may be operated so as to increase the opening thereof in order to reduce the high pressure HP or, vice versa, if the value of the high pressure HP is less than the set-point value Stp, the expansion valve 13 may be operated so as to reduce the opening thereof in order to increase the value of the high pressure HP.

The limit range may comprise:

an upper limit band H-offset, with values greater than the optimal set-point value;

a lower limit band L-offset, with values lower than the optimal set-point value.

The limit bands may be established depending on safety criteria of the system intended to avoid reaching too high or too low set-point values which may create problems, or acceptable bands for optimization of the system itself derived from experiments and/or from empirical tests carried out on the specific apparatus provided.

For example, if the primary parameter is the superheat temperature Tsh, the limit bands may be set so as to avoid reaching set-point values Stp which are too high, i.e. which may create temperatures too high for the outlet of the compressor 11 or vice versa values which are too low and which may create problems of liquid return to the compressor 11.

If the primary parameter is the high pressure HP, the said limit bands may be set so as to avoid reaching values of the high pressure HP which are too high or too low so not to lose the optimization of the system in terms of energy efficiency.

For example, if the primary parameter is the superheat temperature Tsh and the set-point value Stp is equal to 10 K, the maximum limit value of the upper limit band H-offset may be 10 K in order to reach a maximum set point Stp equal to 20 K so as not to have problems associated with too high outlet temperatures of the compressor 11, and the maximum limit value of the lower limit band L-offset may be 7 K for a minimum resultant set-point value of 3 K so as not to have problems of liquid return to the compressor 11. If the primary parameter is the high pressure, the upper limit value of the upper limit band H-offset may be 5 bar and the lower limit value of the lower limit band L-offset may be 3 bar.

If said secondary pressure is the high pressure HP, said optimal value Vo may be calculated, in connection with the operation V, by means of the following formula, already discussed further above:

$$Vo=(2.778-0.0157*te)*tc+(0.381*te-9.34)$$

wherein:

tc is the gas cooler outlet temperature 12 te is the saturated evaporation temperature, for example which can be obtained from the evaporation pressure pe converted into saturation temperature of the CO2.

In this case the optimal value Vo will be variable, as represented by a continuous line in FIG. 1.

If said secondary parameter is the superheat temperature Tsh, said optimal value Vo, in connection with the operation C, may be defined with a fixed value, as represented by a broken line in FIG. 1.

Said method may also comprise an operation E of detecting an optimization temperature value To, consisting of the temperature of said refrigerant fluid downstream of the gas cooler 12.

In particular, if said primary parameter is the high pressure HP, the set-point value may be set so as to optimize the COP of the compressor assembly 11 depending on the optimization temperature value To, in a per se conventional manner.

If said primary parameter is the superheat temperature Tsh the optimal set-point value may be set so as to optimize the efficiency of the evaporator and to a value such as to prevent liquid return to the compressor 11.

Said variation of the set-point value Stp may consist in an increase of the set-point value if the value of the secondary parameter is lower than the optimal value Vo or may be a decrease if the value of the secondary parameter is greater than the optimal value Vo.

The tolerance range It may comprise:

an upper dead band Hdb of values greater than the optimal value Vo;

a lower dead band Ldb of values lower than the optimal value Vo.

The dead bands Hdb and Ldb may be established depending on the same criteria used for definition of the said upper and lower limit bands.

For example, if the secondary parameter is the superheat temperature Tsh, the upper limit value of the upper dead band HdB may be 10° C. and the lower limit value of the lower dead band Ldb may be 3° C.

If the secondary parameter is the high pressure, the upper limit value of the upper dead band Hdb may be 4 bar and the lower limit value of the lower dead band Ldb may be 2 bar.

In general, the present invention also relates to a single-valve CO2 refrigerating apparatus which comprises, in sequence:

a compressor assembly 11;

a gas cooler 12 connected to the compressor assembly 11 so as to receive gas under pressure from it;

an expansion valve 13, with adjustable opening, located downstream of the gas cooler 12, for expanding refrigerant fluid supplied from the latter;

an evaporator 14, located downstream of the valve and upstream of the compressor assembly 11.

Wherein the apparatus 10 furthermore comprises:

temperature detection means 15*a*, 15*b* configured to detect an superheat temperature value Tsh of the refrigerant fluid, preferably by means of a temperature detection downstream of the evaporator 14 or upstream of the compressor 11 and to detect a temperature value of the refrigerant fluid downstream of said gas cooler 12;

pressure detection means 16*a*, 16*b*, for detecting a high-pressure value HP of the pressure of the refrigerant fluid downstream of the compressor assembly 11 and upstream of the expansion valve 13;

a controller 17 connected to the temperature detection means 15*a*, 15*b* and to the pressure detection means 16*a*, 16*b*, so as to receive data from them, and to the expansion valve 13 and configured or programmed so as to adjust the opening of the expansion valve 13 in accordance with a regulation method as described above.

The temperature detection means 15*a*, 15*b* may comprise:

a first sensor 15*a* designed to detect directly or indirectly a temperature of the refrigerant fluid at the outlet of the evaporator 14 or at the intake of the compressor, for detecting the superheat temperature Tsh, for example as more fully described above;

a second sensor 15*b* designed to detect directly or indirectly a temperature of the refrigerating fluid at the outlet of the gas cooler 12, for detecting the optimization temperature To.

The pressure detection means may comprise a third sensor 16*b* designed to detect directly or indirectly a pressure of the refrigerant fluid at the outlet of the gas cooler 12, for detecting said high pressure Hp; they may also comprise a fourth sensor 16*a* designed to detect directly or indirectly a pressure of the refrigerant fluid at the outlet of the evaporator 14 or at the intake of the compressor 11, for detecting the evaporation pressure pe.

The operation of an apparatus 10, in accordance with a regulation method as described above, according to the present invention, may be as follows.

If the primary parameter is the superheat temperature Tsh and therefore the secondary parameter is the high pressure Hp, then, if the value of the high pressure Hp detected, for example by means of the third sensor 16*a*, is within the said tolerance range It, the set-point value Stp will not be varied.

Otherwise, if the value of the high pressure Hp detected is lower than the optimal value Vo less the lower dead band Ldb, then, in connection with the operation D, said variation of the set-point value Spt is performed, for example in a linearly proportional manner with respect to the high-pressure value Hp detected so as to cause an increase of the set-point value Stp such that the superheat temperature Tsh is lower than this set-point value Stp and, in connection with the operation B, the expansion valve 13 will tend to close so as to increase the value of the superheat temperature in order to reach the set-point value Stp.

This gradual closing of the expansion valve 13 tends to increase the value of the high pressure Hp, preventing it therefore from falling further and causing it to return back within the tolerance range It or finding an equilibrium for the system.

The maximum variation of the set point value Stp will be determined by the maximum value of the limit range II defined for the set point value Stp.

Following any further reduction of the high pressure Hp, the set point value Stp preferably will not vary further.

Vice versa, if the high pressure Hp increases beyond the optimal value Vo plus the upper dead band Hdb, the set-point value Stp of the superheat temperature decreases such that the expansion valve 13 will tend to open so as to follow the set point Stp and, in so doing, tends to cause a reduction of the high pressure Hp.

The lower value which limits the variation of the set point Stp will be determined by the minimum value of the limit range II defined for the set-point value Stp.

Following any further increase of the high pressure Hp, the set-point value Stp preferably will not vary further.

The same operating principle, mutatis mutandis, exists where the primary parameter is the high pressure Hp.

It can therefore be understood how the invention is able to solve the problem posed and fulfil the aforementioned task and achieve the aforementioned objects. In particular, with a single-valve CO2 refrigerating apparatus and a method for regulation thereof, according to the present invention, it is possible to increase the energy efficiency without increasing substantially the structural complexity or dimensions thereof.

Furthermore, it is possible to optimize the operation with respect to a combination of functional thermodynamic parameters and specifically according to the superheat temperature at the outlet of the evaporator or at the inlet of the compressor, or in section between them, and according to the maximum cycle pressure, namely the aforementioned high pressure Hp.

In particular, in the case of regulation with the primary parameter consisting of the superheat temperature and secondary parameter consisting of the high pressure, the advantage is that of controlling superheat, but limiting the possible variations of the high pressure so as not to deviate too far from the optimal pressure which maximizes the efficiency of the system.

In the case, instead, of regulation with the primary parameter consisting of the high pressure and secondary parameter consisting of the superheat temperature, the advantage is that of regulating the system based on the pressure which optimizes the efficiency of the cycle, while keeping under control superheat so as to avoid creating problems for the compressor with too low or too high superheat. The invention thus devised may be subject to numerous modifications and variations, all of which fall within the scope of protection of the attached claims. Moreover all the details may be replaced by other technically equivalent elements.

In practice the materials used as well as the associated forms and dimensions may be varied depending on the particular requirements and the state of the art. Where the constructional characteristics and the techniques mentioned in the following claims are followed by reference numbers or symbols, these reference numbers or symbols have been assigned with the sole purpose of facilitating understanding of the said claims and consequently they do not limit in any way the interpretation of each element which is identified, purely by way of example, by said reference numbers or symbols.

The invention claimed is:

1. A method for regulation of a single-valve $CO_2$ refrigerating apparatus which comprises, in sequence:

a compressor assembly (11);

a gas cooler (12) connected to said compressor assembly (11) so as to receive from the compressor assembly, gas under pressure;

an expansion valve (13), with an adjustable opening, located downstream of said gas cooler (12), for expanding a refrigerant fluid supplied therefrom; and an evaporator (14), located downstream of said expansion valve and upstream of said compressor assembly (11);

said apparatus further comprising:

temperature detection means (15*a*, 15*b*), configured to detect a superheat temperature value Tsh of said refrigerant fluid, by means of a temperature detection downstream of said evaporator (14) or upstream of said compressor (11), and to detect a temperature value of the refrigerant fluid downstream of said gas cooler (12);

pressure detection means (16*a*, 16*b*), for detecting a high-pressure value HP of the pressure of said refrigerant fluid downstream of said compressor assembly (11) and upstream of said expansion valve (13); and a controller (17) connected to said temperature detection means (15*a*, 15*b*) and to said pressure detection means (16*a*, 16*b*), so as to receive data from them, and to said expansion valve (13) so as to adjust said opening thereof according to said method;

said method comprising:

an operation A of detecting, over time, the value of a primary parameter and the value of a secondary parameter, wherein said primary parameter is chosen from said high pressure HP and said superheat temperature Tsh, wherein said secondary parameter is said superheat temperature Tsh if said primary parameter is said high pressure HP or is said high pressure HP if said primary parameter is said superheat temperature Tsh;

a primary regulation operation B, which involves regulation of said expansion valve (13) so that the value of said primary parameter, detected in said operation A, tends towards a set-point value;

an operation C of estimating an optimal value Vo for said secondary parameter, wherein said optimal value is estimated according to an algorithm for energy optimization of said refrigerating apparatus; and a secondary regulation operation D which involves varying said set-point value from an optimal set-point value or from a current value if the value of said secondary parameter, detected in said operation A, does not fall within a predefined tolerance range It of values comprising said optimal value Vo; wherein said variation is made so as to tend to bring the value of said secondary parameter back within said predefined tolerance range It.

2. The method according to claim 1, wherein said method comprises an operation E of detecting an optimization temperature value To, consisting of the temperature of said refrigerant fluid downstream of said gas cooler (12);

wherein:

if said primary parameter is said high pressure HP, said optimal set-point value is set so as to optimize the COP of said compressor assembly (11) depending on the value of said optimization temperature To; and if said primary parameter is said superheat temperature Tsh, said optimal set-point value is set so as to optimize the efficiency of the evaporator (14) and to a value that ensures no liquid return to said compressor assembly (11).

3. The method according to claim 1, wherein said variation consists of an increase of said set-point value if the value of said secondary parameter is lower than said optimal value Vo, or of a decrease if the value of said secondary parameter is greater than said optimal value Vo.

4. The method according to claim 1, wherein said predefined tolerance range It comprises:

an upper dead band (Hdb) of values greater than said optimal value Vo; and a lower dead band (Ldb) of values lower than said optimal value Vo.

5. The method according to claim 1, wherein said superheat temperature Tsh is calculated as the difference between a measured temperature ts, detected at an intake of said compressor assembly (11) or at an outlet of said evaporator (14) and a saturated evaporation temperature to which is obtained from a direct measurement of temperature or from an evaporation pressure value pe converted into a saturated temperature of the $CO_2$, wherein said evaporation pressure value pe may be the pressure of said refrigerant fluid detected at the outlet of said evaporator (14) or at the intake of said compressor assembly (11) or in a section therebetween.

6. The method according to claim 5, wherein said method comprises an operation E of detecting an optimization temperature value To, consisting of the temperature of said refrigerant fluid downstream of said gas cooler (12);

wherein:

if said primary parameter is said high pressure HP, said optimal set-point value is set so as to optimize the COP of said compressor assembly (11) depending on the value of said optimization temperature To;

if said primary parameter is said superheat temperature Tsh, said optimal set-point value is set so as to optimize the efficiency of the evaporator (14) and to a value that ensures no liquid return to said compressor assembly (11).

7. The method according to claim 6 wherein said variation consists of an increase of said set-point value if the value of said secondary parameter is lower than said optimal value Vo, or of a decrease if the value of said secondary parameter is greater than said optimal value Vo.

8. The method according to claim 6, wherein said predefined tolerance range It comprises:

an upper dead band (Hdb) of values greater than said optimal value Vo; and a lower dead band (Ldb) of values lower than said optimal value Vo.

9. The method according to claim 1, wherein said secondary regulation operation D is such that said variation is limited to values of said set-point value included in a predefined limit range 1I comprising said optimal set-point value.

10. The method according to claim 9, wherein said method comprises an operation E of detecting an optimization temperature value To, consisting of the temperature of said refrigerant fluid downstream of said gas cooler (12);

wherein:

if said primary parameter is said high pressure HP, said optimal set-point value is set so as to optimize the COP of said compressor assembly (11) depending on the value of said optimization temperature To;

if said primary parameter is said superheat temperature Tsh, said optimal set-point value is set so as to optimize the efficiency of the evaporator (14) and to a value that ensures no liquid return to said compressor assembly (11).

11. The method according to claim 10, wherein said predefined tolerance range It comprises:

an upper dead band (Hdb) of values greater than said optimal value Vo; and a lower dead band (Ldb) of values lower than said optimal value Vo.

12. The method according to claim 10 wherein said variation consists of an increase of said set-point value if the value of said secondary parameter is lower than said optimal value Vo, or of a decrease if the value of said secondary parameter is greater than said optimal value Vo.

13. The method according to claim 12, wherein said predefined tolerance range It comprises:

an upper dead band (Hdb) of values greater than said optimal value Vo; and a lower dead band (Ldb) of values lower than said optimal value Vo.

14. The method according to claim 9, wherein said predefined limit range 1I comprises:

an upper limit band (H-offset) of values greater than said optimal set-point value; and a lower limit band (L-offset) of values lower than said optimal set-point value.

15. The method according to claim 14, wherein said method comprises an operation E of detecting an optimization temperature value To, consisting of the temperature of said refrigerant fluid downstream of said gas cooler (12);

wherein:

if said primary parameter is said high pressure HP, said optimal set-point value is set so as to optimize the COP of said compressor assembly (11) depending on the value of said optimization temperature To;

if said primary parameter is said superheat temperature Tsh, said optimal set-point value is set so as to optimize the efficiency of the evaporator (14) and to a value that ensures no liquid return to said compressor assembly (11).

16. The method according to claim 15, wherein said predefined tolerance range It comprises:

an upper dead band (Hdb) of values greater than said optimal value Vo; and a lower dead band (Ldb) of values lower than said optimal value Vo.

17. The method according to claim 15 wherein said variation consists of an increase of said set-point value if the value of said secondary parameter is lower than said optimal value Vo, or of a decrease if the value of said secondary parameter is greater than said optimal value Vo.

18. The method according to claim 17, wherein said predefined tolerance range It comprises:

an upper dead band (Hdb) of values greater than said optimal value Vo; and a lower dead band (Ldb) of values lower than said optimal value Vo.

19. A single-valve $CO_2$ refrigerating apparatus which comprises, in sequence:

a compressor assembly (11);

a gas cooler (12) connected to said compressor assembly (11) so as to receive from the compressor assembly, gas under pressure;

an expansion valve (13), with an adjustable opening, located downstream of said gas cooler (12), for expanding a refrigerant fluid supplied therefrom; and an evaporator (14), located downstream of said expansion valve and upstream of said compressor assembly (11);

said apparatus further comprising:

temperature detection means (15*a*, 15*b*), configured to detect a superheat temperature value Tsh of said refrigerant fluid, by means of temperature detection downstream of said evaporator (14) or upstream of said compressor (11), and to detect a temperature value of the refrigerant fluid downstream of said gas cooler (12);

pressure detection means (16*a*, 16*b*), for detecting a high-pressure value HP of the pressure of said refrigerant fluid downstream of said compressor assembly (11) and upstream of said expansion valve (13); and a controller (17) connected to said temperature detection means (15*a*, 15*b*) and to said pressure detection means (16*a*, 16*b*), so as to receive data from them, and to said expansion valve (13), the controller operable to adjust the opening of said expansion valve (13) by the following operations:

an operation A of detecting, over time, the value of a primary parameter and the value of a secondary parameter, wherein said primary parameter is chosen from said high pressure HP and said superheat temperature Tsh, wherein said secondary parameter is said superheat temperature Tsh if said primary parameter is said high pressure HP or is said high pressure HP if said primary parameter is said superheat temperature Tsh;

a primary regulation operation B, which involves regulation of said expansion valve (13) so that the value of said primary parameter, detected in said operation A, tends towards a set-point value;

an operation C of estimating an optimal value Vo for said secondary parameter, wherein said optimal value is estimated according to an algorithm for energy optimization of said refrigerating apparatus; and a secondary regulation operation D which involves varying said set-point value from an optimal set-point value or from a current value if the value of said secondary parameter, detected in said operation A, does not fall within a predefined tolerance range It of values comprising said optimal value Vo; wherein said variation is made so as to tend to bring the value of said secondary parameter back within said predefined tolerance range It.

20. The apparatus according to claim 19, wherein said temperature detection means (15*a*, 15*b*) comprise:

a first sensor (15*a*) designed to detect directly or indirectly a temperature of said refrigerant fluid at an outlet of said evaporator (14) or at an intake of said compressor assembly (11) or at a section comprised between them, for detecting said superheat temperature Tsh;

a second sensor (15*b*) designed to detect directly or indirectly a temperature of said refrigerant fluid at an outlet of said gas cooler (12), for detecting an optimization temperature To (Ht);

said pressure detection means comprising a third sensor (16*b*) designed to detect directly or indirectly a pressure of said refrigerant fluid at the outlet of said gas cooler (12), for detecting said high pressure HP.

* * * * *